US010455989B2

(12) United States Patent
Wei

(10) Patent No.: US 10,455,989 B2
(45) Date of Patent: Oct. 29, 2019

(54) SHOWER DOOR

(71) Applicant: Ideal Sanitary Ware Co., Ltd., Foshan (CN)

(72) Inventor: Wuxiang Wei, Foshan (CN)

(73) Assignee: Ideal Sanitary Ware Co., Ltd. (CN)

( * ) Notice: Subject to any disclaimer, the term of this patent is extended or adjusted under 35 U.S.C. 154(b) by 54 days.

(21) Appl. No.: 15/559,332

(22) PCT Filed: Jun. 2, 2016

(86) PCT No.: PCT/CN2016/084513
§ 371 (c)(1),
(2) Date: Sep. 18, 2017

(87) PCT Pub. No.: WO2017/197666
PCT Pub. Date: Nov. 23, 2017

(65) Prior Publication Data

US 2018/0184853 A1 Jul. 5, 2018

(30) Foreign Application Priority Data

May 18, 2016 (CN) ..... 2016 1 0330855

(51) Int. Cl.
*A47K 3/34* (2006.01)
*E05D 13/00* (2006.01)
(Continued)

(52) U.S. Cl.
CPC ..... *A47K 3/34* (2013.01); *E05D 13/00* (2013.01); *E05D 15/063* (2013.01);
(Continued)

(58) Field of Classification Search
CPC ..... A47K 3/34; E05F 5/003; E05D 15/063; E05Y 2900/114
See application file for complete search history.

(56) References Cited

U.S. PATENT DOCUMENTS 8,307,497 B2 * 11/2012 Chang ..... E05F 5/003 16/49
9,388,622 B1 * 7/2016 Paron ..... E05F 15/56
(Continued)

FOREIGN PATENT DOCUMENTS

CN 202941998 U 5/2013
CN 204552399 U 8/2015
(Continued)

OTHER PUBLICATIONS

International Search Report for Application No. PCT/CN2016/084513 dated Feb. 24, 2017, 5 pages.

*Primary Examiner* — Gregory J Strimbu
(74) *Attorney, Agent, or Firm* — Lerner, David, Littenberg, Krumholz, & Mentlik, LLP

(57) ABSTRACT

A shower door comprises a movable door, wherein at least one rolling wheel is fixed on the movable door, and at least one limiting member is fixed on the movable door; the shower door further comprises a track, the track is arranged below the rolling wheel, a closer is fixed on the track, the closer comprises a clamping member and a middle portion of the clamping member is provided with a clamping mouth facing upwards; and the limiting member comprises a limiting block and an anti-bouncing block, wherein the limiting block is located above the track, the limiting block is capable of being clamped in the clamping mouth of the clamping member and the anti-bouncing block is located below the track.

7 Claims, 6 Drawing Sheets

(51) Int. Cl.
*E05D 15/06* (2006.01)
*E05F 5/00* (2017.01)
*E06B 3/46* (2006.01)

(52) U.S. Cl.
CPC ..... *E05D 15/0652* (2013.01); *E05F 5/003* (2013.01); *E06B 3/4636* (2013.01); *E05Y 2201/212* (2013.01); *E05Y 2201/224* (2013.01); *E05Y 2201/614* (2013.01); *E05Y 2900/112* (2013.01); *E05Y 2900/114* (2013.01)

(56) References Cited

U.S. PATENT DOCUMENTS

2006/0185250 A1* 8/2006 Gosling ..... E05F 5/10 49/409
2007/0283640 A1* 12/2007 Shivak ..... E04B 2/7455 52/207
2008/0202030 A1* 8/2008 Heiniger ..... E05D 15/1021 49/224
2009/0077898 A1* 3/2009 Gerichten ..... E05D 15/063 49/506
2010/0031577 A1* 2/2010 Haab ..... E05D 15/0634 49/449
2011/0099909 A1* 5/2011 Stommel ..... E05F 1/16 49/413
2013/0091665 A1* 4/2013 Tsai ..... E05F 3/18 16/49
2017/0254130 A1* 9/2017 Cano ..... A47K 3/34
2018/0242795 A1* 8/2018 Ball ..... A47K 3/34

FOREIGN PATENT DOCUMENTS

CN 204691568 U 10/2015
CN 204703652 U 10/2015
CN 205814240 U 12/2016
EP 2617336 A2 7/2013

* cited by examiner

SHOWER DOOR

CROSS REFERENCE TO RELATED APPLICATIONS

The present application is a national phase entry under 35 U.S.C. § 371 of International Application No. PCT/CN2016/084513, filed Jun. 2, 2016, which claims priority from Chinese Patent Application No. 201610330855.X filed May 18, 2016, all of which are hereby incorporated herein by reference.

TECHNICAL FIELD

The present invention relates to the field of bathroom accessories, in particular to a shower door mounted in a shower room. The present invention is based on a Chinese invention patent application No. CN201610330855.X filed on May 18, 2016, which is incorporated herein by reference in its entirety.

BACKGROUND ART

Nowadays, people usually arrange a shower room in a toilet during decoration. Existing shower rooms usually use shower doors with glass plates. Existing shower doors are mainly divided into two structures, respectively including openable and closable doors with tracks and hinge doors with hinges.

A hinge door has a framework which is made of metal, a glass plate is provided in the framework, usually the framework is provided with a frame, the frame is fixed on a wall, a pivot door with a glass plate is fixed on the frame and thereby the fixation of the glass plate and the fixed frame is realized. Usually, a pivot is provided on the pivot door, the glass plate is fixed on the pivot and the pivot door can rotate around the pivot and thereby the opening and closing of the pivot door are realized.

An openable and closable door has a framework which is made of metal, the framework comprises one or two tracks, the track is arranged at an upper end or a lower end of the shower door and the track is substantially arranged in flush with the ground. In addition, a frame is provided on each of two sides of the framework, the frame is arranged perpendicular to the rack and the frame is fixedly connected with the track. At least two glass plates are provided in the framework, the plurality of glass plates may all be movable glass plates which can slide back and forth in the track and may also include at least one fixed glass plate which cannot slide relative to the track. If a fixed glass plate is arranged, usually the fixed glass plate is called as a fixed door, the shower door at least includes one movable glass plate which can slide back and forth in the track and usually the movable glass plate is called as a movable door.

In order to realize back-and-forth sliding of the movable door, usually two rolling wheels are arranged on the movable door and the rolling wheels can slide on the track to realize the opening and closing of the movable door. Since the weight of the movable door is comparatively great, when the movable door is opened and closed, usually a comparatively great force is needed for pushing. However, since the weight of the movable door is great, the inertia is also comparatively great. When the movable door is opened or closed to a limit position, the movable door will hit against the frame or a limiting member, and consequently a very great impact is caused to the movable door, the frame and the track. If the impact force is great, possibly the movable door or the frame is caused to be damaged and thereby the use of the shower door is influenced.

For this reason, currently there is a shower door, a closer is mounted on a track, a clamping member is provided on the closer and a limiting member is provided on a movable door. When the movable door slides, the limiting member can slide to a position inside the clamping member. Thereby, since the clamping member further needs to be driven to slide when the movable door slides, the sliding resistance of the movable door is increased, thus the impact force when the movable door slides to a limit position is decreased and the movable door or a frame is prevented from being damaged.

However, the movable door easily bounces up and down in a sliding process, resulting that the movable door falls off from the track and the use safety of the shower door is influenced.

Technical Problem

In order to solve the above-mentioned problem, a main purpose of the present invention is to provide a shower door which can be prevented from falling off from a track and can reduce the impact force produced when a movable door is opened and closed.

Technical Solution

In order to realize the above-mentioned main purpose, the present invention provides a shower door comprising a movable door, at least one rolling wheel being fixed on the movable door and at least one limiting member being fixed on the movable door; the shower door further comprises a track assembly, the track assembly comprising a track, the track being arranged below the rolling wheel, a closer being fixed on the track, the closer comprising a clamping member and a middle portion of the clamping member being provided with a clamping mouth facing upwards when the closer is fixed on the track; and in addition, the limiting member comprises a limiting block and an anti-bouncing block, the limiting block is located above the track, the limiting block is adapted for being clamped in the clamping mouth of the clamping member and the anti-bouncing block is located below the track.

In a preferred solution, the limiting member further comprises a limiting member body, the limiting block and the anti-bouncing block are respectively located at two ends of the limiting member body.

In a further solution, an attaching piece is provided on one side, close to the track, of the limiting member body, and the attaching piece is attached to a surface of the track.

In a further solution, two threaded holes are provided in the limiting member body and screws penetrate through the threaded holes and fix the limiting member on the movable door.

In a further solution, a circular groove is provided in a circumference of the rolling wheel, the groove is mounted on the track, and a distance between the anti-bouncing block and a lower wall of the track is smaller than a depth of the groove of the rolling wheel.

In a further solution, one closer is provided at each of two ends of the track and one clamping member is provided on each closer.

In a further solution, the closer further comprises a strip-shaped body, a sliding groove is provided in the body, the clamping member is slidable back and forth in the sliding groove, one end of the sliding groove is provided with a concave hole, the clamping member is obliquely arranged relative to the body when the clamping member slides to the concave hole and one clamping block of the clamping member is located in the concave hole.

Beneficial Effects

Since the closer is provided on the track of the shower door provided by the present invention and the clamping mouth is provided on the clamping member on the closer, when the movable door slides to a limit position, the limiting block of the limiting member slides to a position inside the clamping mouth, thus the sliding speed of the movable door is reduced, the movable door can be effectively prevented from causing a very great impact force to the frame and the track through the cushioning effect of the clamping member and the limiting member, and thus the movable door and the track are prevented from being damaged. In addition, since the limiting member is further provided with the anti-bouncing block and the anti-bouncing block is located below the track, the movable door can be prevented from falling off from the track through the joint effect of the limiting block located above the track and the anti-bouncing block located below the track.

Besides, since the limiting block and the anti-bouncing block are respectively located at the two ends of the limiting member body, when the movable door slides, the anti-bouncing block can better prevent the movable door from bouncing upwards, and thus the stable sliding of the movable door is guaranteed. In addition, since the limiting member is fixed on the movable door through two screws, the limiting member is prevented from rotating relative to the movable door and the relative position relationship among the limiting block, the anti-bouncing block and the track is guaranteed as well.

Further, since the clamping member can slide back and forth on the sliding groove of the closer, the clamping member slides with the limiting member in a process that the movable door slides back and forth, the limiting member slides to a position inside the clamping mouth of the clamping member after the movable door slides to a certain position, the sliding speed of the movable door is decreased when the limiting member slides into the clamping mouth, the movable door further needs to drive the clamping member to slide in the body of the closer after the limiting member slides into the clamping mouth, thus the sliding speed of the movable door is slowed down and thus the impact caused by the movable door to the frame is effectively decreased.

Besides, since one end of the sliding groove is provided with the concave hole, the clamping member is obliquely arranged when the clamping member slides to the end portion of the sliding groove, thus the limiting block is facilitated to slide into the clamping mouth of the clamping member and the limiting block is also facilitated to slide out of the clamping mouth when the movable door slides towards an opening direction.

The present invention will be further described below with reference to the drawings in combination with the embodiments.

DESCRIPTION OF THE EMBODIMENTS

Figure 1:
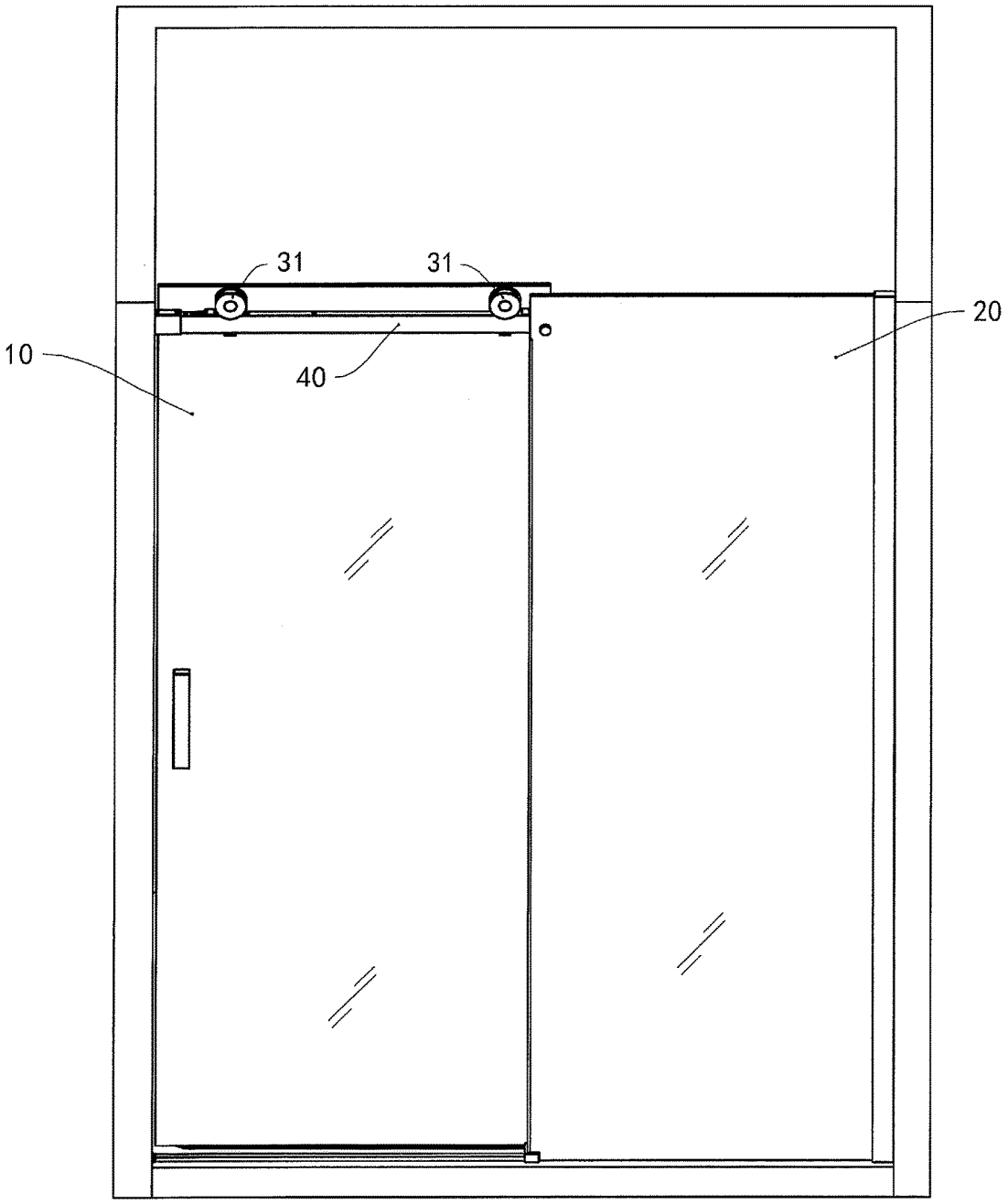
FIG. 1 illustrates a structural view of a shower door mounted in a shower room according to an embodiment of the present invention.

A shower door provided by the present invention is installed in a shower room. Referring to FIG. 1, the shower door provided by this embodiment comprises a movable door 10 and a fixed door 20, a track assembly 40 is provided at upper ends of the movable door 10 and the fixed door 20, and the movable door 10 and the fixed door 20 are respectively arranged on two sides of the track assembly 40. As illustrated in FIG. 1, the movable door 10 is located on one side, close to a paper surface, of the track assembly 40, and the fixed door 20 is located on one side, away from the paper surface, of the track assembly 40. In addition, the movable door 10 and the fixed door 20 are arranged in parallel, the fixed door 20 is fixed relative to the track assembly 40 and the movable door 10 can slide back and forth relative to the track assembly 40.

Figure 2:
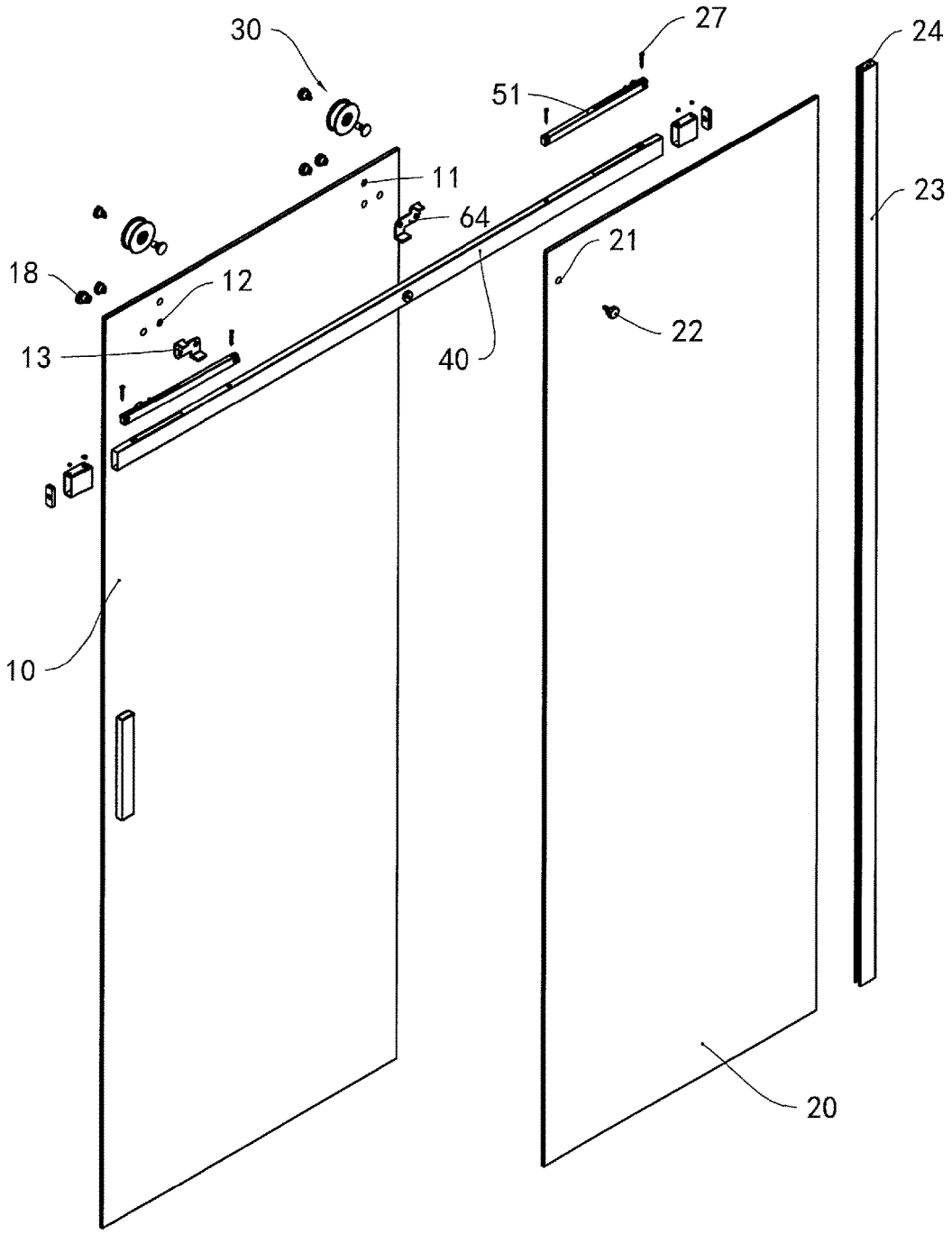
FIG. 2 illustrates a structural exploded view of a shower door according to an embodiment of the present invention.
Figure 3:
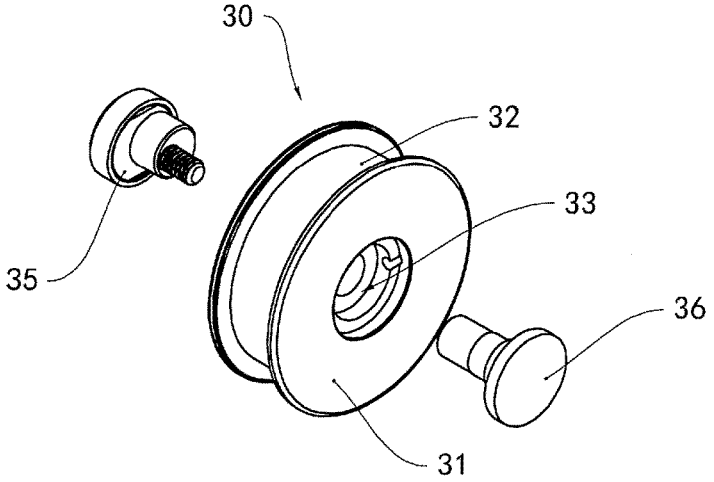
FIG. 3 illustrates a structural enlarged view of a rolling wheel assembly in a shower door according to an embodiment of the present invention.

Referring to FIG. 2, the upper end of the movable door 10 is provided with two through holes 11 and the two through holes 11 are respectively located in upper ends of left and right sides of the movable door 10. Two rolling wheel assemblies 30 are provided on the movable door 10, and each rolling wheel assembly 30 is fixed on the movable door 10 through one through hole 11. Referring to FIG. 3, each rolling wheel assembly 30 has a rolling wheel 31, the rolling wheel 31 is substantially cylindrical, a circular groove 32 is provided on a circumference of the rolling wheel 31, and the outer diameter of the rolling wheel 31 at the position of the groove 32 is smaller than the outer diameter at the position of sidewalls on two sides.

A middle portion of the rolling wheel 31 is further provided with a through hole 33, an axle 36 penetrates through the through hole 33, and the rolling wheel 31 can rotate around an axis of the rolling wheel 31 relative to the axle. An internal threaded hole is provided in the axle 36 and a screw 35 is screwed into the axle 36. In addition, the screw 35 penetrates through the through hole 11 in the movable door 10 and then is screwed into the internal threaded hole of the axle 36, and thereby the rolling wheel assembly 30 is fixed on the movable door 10 through the through hole 11. Preferably, a bearing is provided in the rolling wheel 31.

Figure 4:
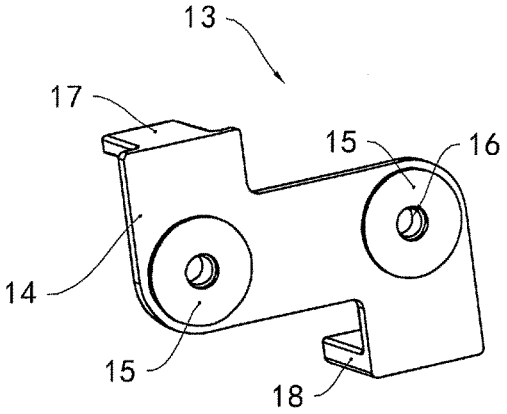
FIG. 4 illustrates a structural enlarged view of one limiting member in a shower door according to an embodiment of the present invention.

Through holes 12 are provided below the through holes 11 and a limiting member 13 is fixed on the movable door 10 by penetrating screws 18 through the through holes 12. Referring to FIG. 4, the limiting member 13 comprises a substantially Z-shaped limiting body 14, one side of the limiting body 14 is provided with two circular attaching pieces 15, a middle portion of the limiting member 13 is provided with two threaded holes 16 and internal threads are provided in the threaded holes 16. The limiting member 13 is arranged on one side, close to the track assembly 40, of the movable door 10. From FIG. 2, it can be seen that the screws 18 penetrate through the through holes 12 and are screwed into the two threaded holes 16 of the limiting member 13 and thereby the limiting member 13 is fixed on the movable door 10.

The limiting member 13 has a limiting block 17 and an anti-bouncing block 18, the limiting block 17 is located at an upper end of the limiting member 13 and the anti-bouncing block 18 is located at a lower end of the limiting member 13. From FIG. 4, it can be seen that the limiting block 17 and the anti-bouncing block 18 are respectively located at two ends of the limiting member 13. Preferably, the limiting block 17 and the anti-bouncing block 18 are both arranged perpendicular to the limiting member body 14.

From FIG. 2, it can be seen that the limiting member 13 is located below one rolling wheel assembly 30 at a left upper end of the movable door 10, the limiting block 17 is located above the track 40 and the anti-bouncing block 18 is located below the track 40.

Figure 5:
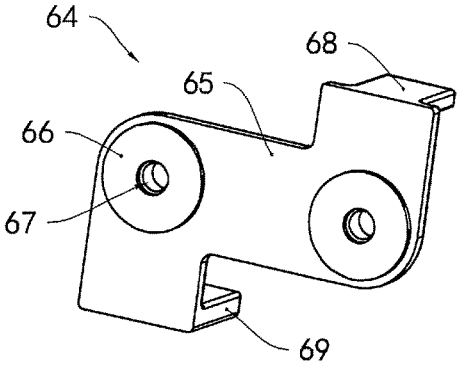
FIG. 5 illustrates a structural enlarged view of another limiting member in a shower door according to an embodiment of the present invention.

Another limiting member 64 is further provided on the movable door 10. Referring to FIG. 5, the limiting member 64 has a limiting member body 65, a limiting block 68 located at an upper end of the limiting member 64 and an anti-bouncing block 69 at a lower end of the limiting member 64 are provided on the limiting member 64, and the limiting block 68 and the anti-bouncing block 69 are respectively located at two ends of the limiting member 64 and are both perpendicular to the limiting member body 65. In addition, two attaching pieces 66 are provided on the limiting member 64, a middle portion of each attaching piece 66 is provided with a threaded hole 67, and the limiting member 64 can be fixed on the movable door 10 by using and penetrating screws through the through holes in the movable door 10 and the threaded holes 67. Since the limiting member 64 is provided with two threaded holes 67, the limiting member 64 can be prevented from rotating relative to the movable door 10. In addition, the limiting member 64 is located below one rolling wheel assembly 30 at a right upper end of the movable door 10.

The upper end of the fixed door 20 is provided with a through hole 21, a screw 22 may penetrate through the through hole 21 and realize fixation of the fixed door 20 and the track assembly 40. One side of the fixed door 20 is provided with a wall fixing member 23, the wall fixing member 23 has a bottom wall attached to a wall surface, the bottom wall extends in a direction toward the fixed door 20 to form a pair of sidewalls, a groove 24 is formed between the bottom wall and the sidewalls, and one side of the fixed door 20 is inserted into the groove 24. Preferably, through holes are provided in the bottom wall of the wall fixing member 23 and the wall fixing member 23 is fixed on the wall surface by using and penetrating screws or rivets through the through holes. Of course, the fixed door 20 may also be fixed on the wall surface through glass clamps or the like.

Figure 6:
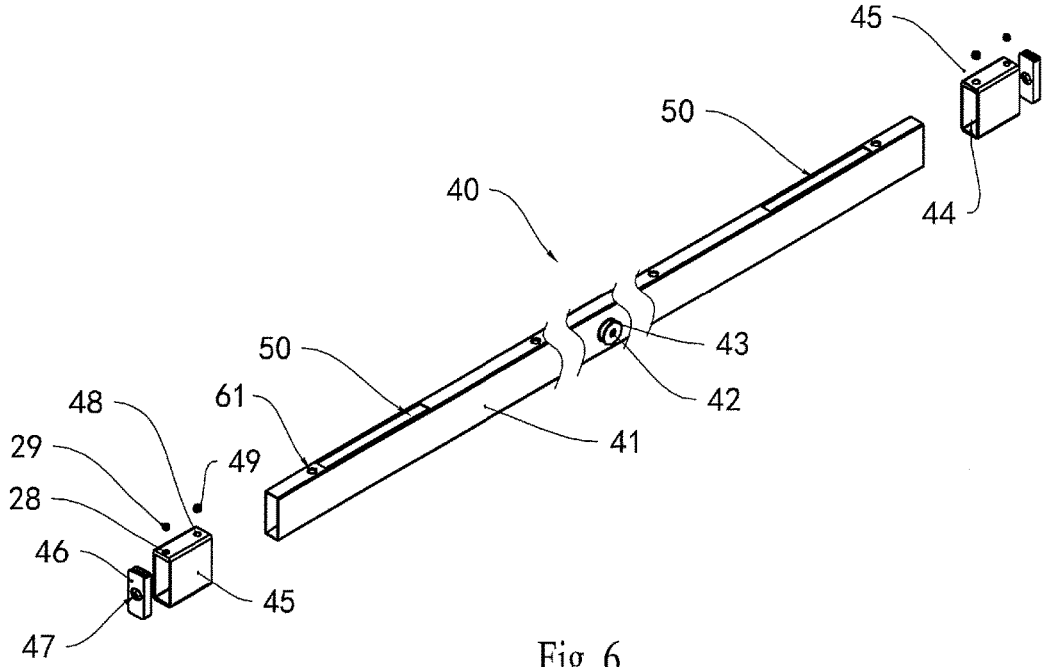
FIG. 6 illustrates a structural exploded view of a track assembly in a shower door according to an embodiment of the present invention.
Figure 7:
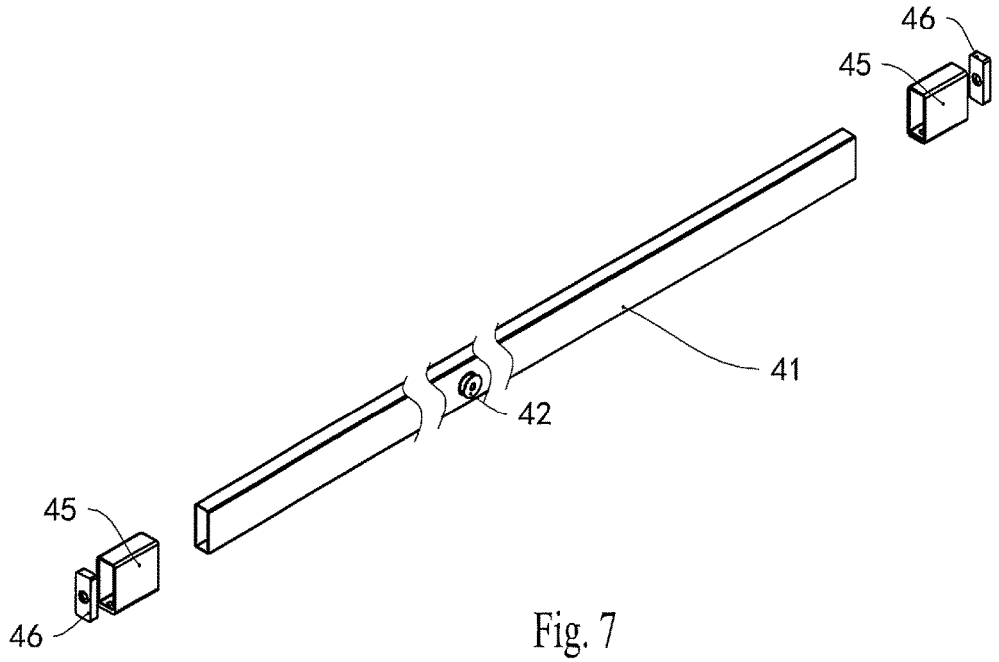
FIG. 7 illustrates a structural exploded view of a track assembly at another view angle in a shower door according to an embodiment of the present invention.

The track assembly 40 comprises a long strip-shaped track 41. Referring to FIG. 6 and FIG. 7, the track 41 is a hollow cuboidal section bar and the cross section of the track 41 is rectangular. A threaded hole 43 is provided in the track 41, a middle portion of a mounting boss 42 is provided with a through hole, and the screw 22 penetrates through the through hole 21, penetrates through the through hole of the mounting boss 42 and is screwed into the threaded hole 43 of the track 41 to realize fixation of the fixed door 20 and the track 41. Since the through hole 21 is provided in the upper end of the fixed door 20, the track 41 is fixed at the upper end of the fixed door 20.

The track assembly 40 further comprises wall sleeves 45 which are arranged at two ends of the track 41, each wall sleeve 45 is substantially cuboidal, a pressing block 46 is provided on one side, close to a wall, of each wall sleeve 45, a through hole 47 is provided in the pressing block 46, and the pressing block 46 may be fixed on the wall surface by using and penetrating a screw through the through hole 47. In addition, end portions of the track 41 may be inserted into the wall sleeves 45, a cavity 44 is formed in each wall sleeve 45, the end portions of the track 41 are inserted into the cavities 44 and thereby the end portions of the track 41 can be prevented from directly abutting against the wall surface and causing the wall surface damaged. A top wall of each wall sleeve 45 is provided with a threaded hole 28, the end, with the threaded hole 28, of each wall sleeve 45 is enabled to sleeve the pressing block 46 and thereby the wall sleeve 45 is fixed with the pressing block 46. Preferably, an upper end of the pressing block 46 is provided with a groove and the wall sleeve 45 can be fixed on the wall surface by using and screwing a screw 29 into the threaded hole 28 and enabling the screw 29 to stretch into the groove.

In order to fix the wall sleeves 45 at the end portions of the track 41, the top wall of each wall sleeve 45 is provided with a threaded hole 48 and a bolt 49 can be screwed into the threaded hole 48. After the bolt 49 is screwed into the threaded hole 48, a lower end of the bolt 49 can abut against an upper surface of the end portion of the track 41 and thereby fixed connection between the track 41 and the wall sleeves 45 is realized. Preferably, the bolt 49 is a hexagon socket bolt, i.e., a middle portion of the bolt 49 is provided with an internal hexagonal hole.

Figure 8:
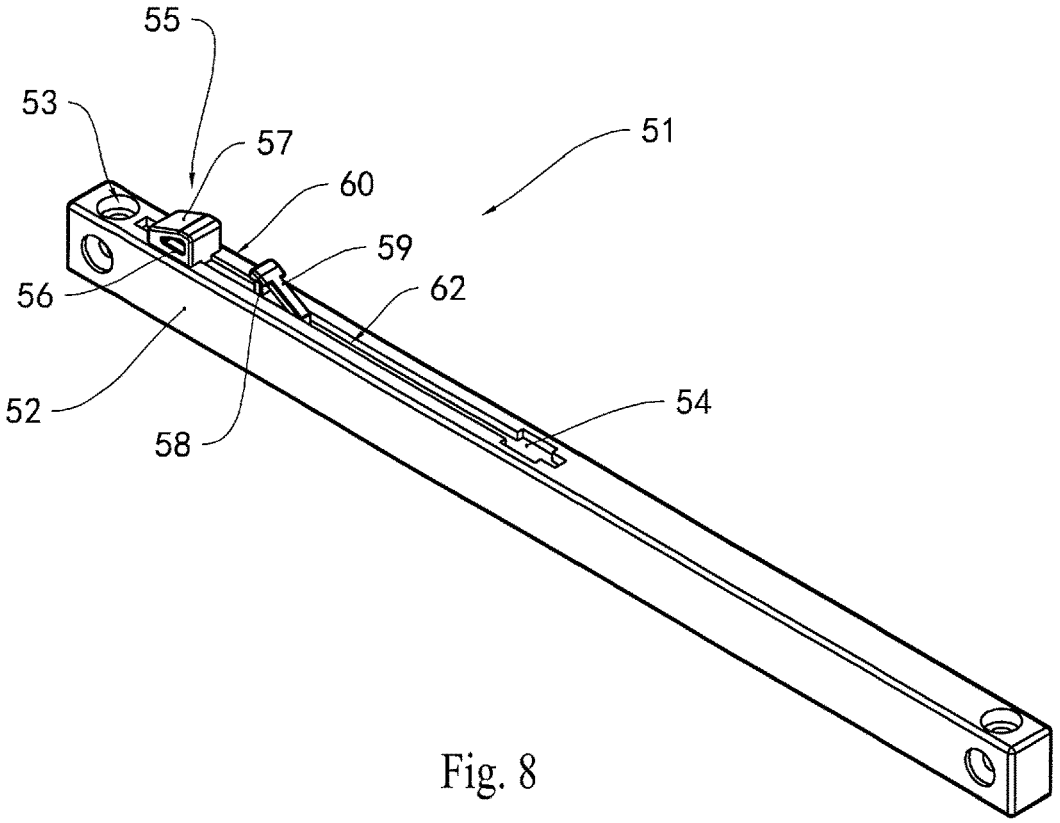
FIG. 8 illustrates a structural enlarged view of a closer in a shower door according to an embodiment of the present invention.

Two mounting grooves 50 are provided in the track 41 and a closer 51 is mounted in each mounting groove 50. As illustrated in FIG. 8, the closer 51 comprises a strip-shaped body 52, a through hole 53 is provided in each of two ends of the body 52, two through holes 61 are provided in an upper wall of each mounting groove 50, and after the closer 51 is mounted in the mounting groove 50, the closer 51 is fixed in the mounting groove 50 by using screws. Of course, the closer 51 may also be fixed in the mounting groove 50 through rivets. Since the closer 51 is mounted in the mounting groove 50, most part of the closer 51 is covered by the track 41, the attractiveness of the openable and closable door of the shower room is not influenced and the closer 51 is very convenient to mount.

Figure 9:
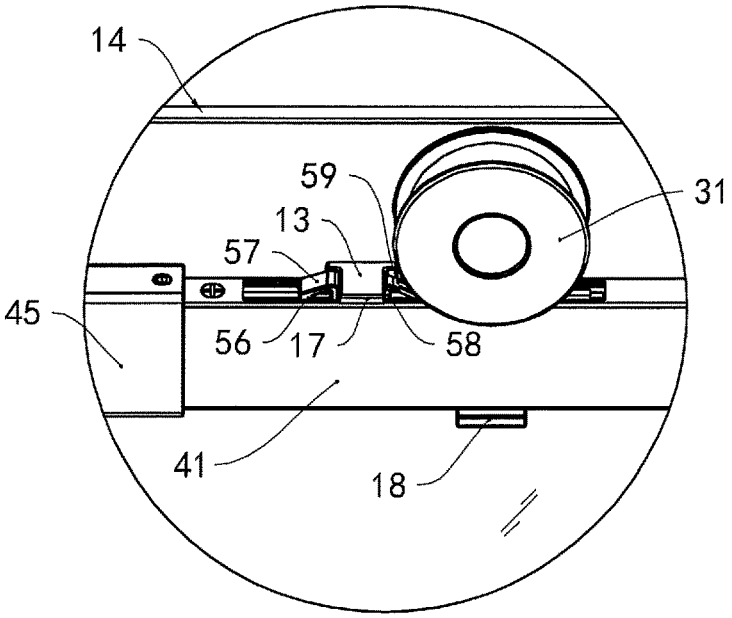
FIG. 9 illustrates a partial structural enlarged view of a shower door according to an embodiment of the present invention.

A clamping member 55 is provided on the closer 51, the clamping member 55 has two clamping blocks 56, 58, the two clamping blocks 56, 58 are respectively located at two ends of the clamping member 55, and a clamping mouth 60 is formed between the two clamping blocks 56, 58. As illustrated in FIG. 9, the limiting block 17 of the limiting member 13 of the movable door 10 may be clamped in the clamping mouth 60 and thus the shape of the clamping mouth 60 is matched with the shape of the limiting block 17. In this embodiment, the clamping block 17 is cuboidal and thus the clamping mouth 60 is rectangular to clamp the limiting block 17.

Since the limiting block 17 may slide into the clamping member 55 and may also slide out of the clamping member 55 in the sliding process of the movable door 10, in order to guarantee that the limiting block 17 smoothly slides into and out of the clamping member 55, portions of outer side surfaces of the two clamping blocks 56, 58 are arranged to be inclined surfaces. For example, the outer side surface of the clamping block 56 has an inclined surface 57 and the inclined surface 57 is obliquely arranged from top to bottom from an outer side of the clamping block 56 to an inner side of the clamping block 56. Similarly, the outer side surface of the clamping block 58 has an inclined surface 59 and the inclined surface 59 is obliquely arranged from top to bottom from an outer side of the clamping block 58 to an inner side of the clamping block 58.

Figure 10:
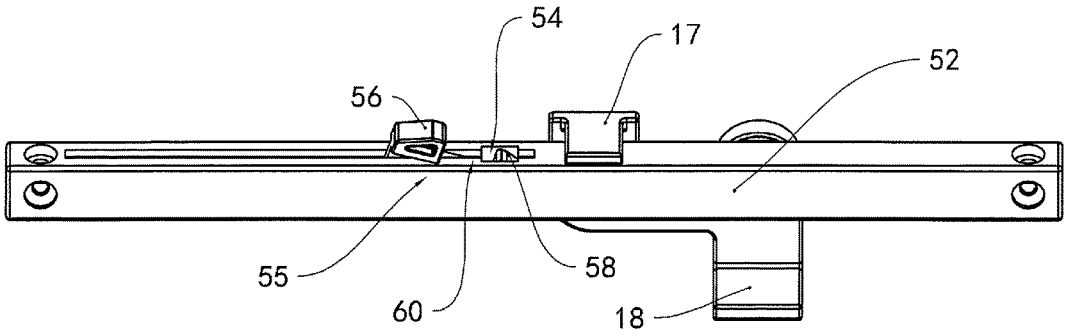
FIG. 10 illustrates a structural enlarged view of a closer and a limiting member under a first state in a shower door according to an embodiment of the present invention.

In addition, an upper end of the closer 51 is provided with a sliding groove 62, and the clamping member 55 is mounted in the sliding groove 62 and may slide back and forth in the sliding groove. One end of the sliding groove 62 is provided with a concave hole 54. From FIG. 8, it can be seen that the concave hole 54 is provided in one end of the sliding groove 62, i.e., one end close to the middle of the closer 51. As illustrated in FIG. 10, when the clamping member 55 slides to the concave hole 54, the clamping member 55 and the body 52 are obliquely arranged, and the clamping block 58, close to the concave hole 54, of the clamping member 55 is fully located in the concave hole 54. Therefore, the cross section area of the concave hole 54 must be greater than the cross section area of the clamping block 58 and the depth of the concave hole 54 also needs to be greater than the downward sliding depth of the clamping block 58. Thereby, the limiting block 17 is facilitated to slide into the clamping mouth 60 or slide out of the clamping mouth 60.

In addition, the anti-bouncing block 18 is located below the track 41. After the track assembly 40 is mounted to the fixed door 20 and the movable door 10 is mounted in place, the rolling wheel 31 is located above the track 41, and the groove 32 of the rolling wheel 31 is mounted on the track 41, i.e., outer walls on two sides of the groove 32 are respectively located outside the track 41. Thereby, the rolling wheel 31 can roll on the track 41 to realize the back-and-forth sliding of the movable door 10. In addition, the anti-bouncing block 18 of the limiting member 13 is below the track 41, the clamping mouth 60 of the clamping member 55 of the closer 51 is upwards formed, only the part of the clamping mouth 60 of the closer is exposed out of the track 41, and most part of the closer 51 is concealed in the track 41 and thus the openable and closable door of the shower room is more attractive. Besides, a distance between the anti-bouncing block 18 of the limiting member 13 and a lower wall of the track 41 is smaller than a depth of the groove 32 of the rolling wheel 31. Thereby, even when the movable door 10 is uplifted, the anti-bouncing block 18 of the limiting member 13 will abut against the lower wall of the track 41 such that the rolling wheel 31 is prevented from falling off from a position above the track 41. In the sliding process of the movable door 10, due to the limiting effect of the clamping member 55 and the limiting member 13, the rolling wheel 31 can be prevented from sliding out of the two ends of the track 41 and thus the movable door 10 is prevented from falling off from the track 41.

When the movable door 10 slides from an opening position to a closing position, i.e., as illustrated in FIG. 1, when the movable door 10 slides from a rightmost position to a leftmost position, as illustrated in FIG. 10, at an initial stage, the limiting member 13 is located on a right side of the clamping member 55, the clamping member 55 slides to a rightmost side of the body 52, i.e., slides to the concave hole 54, and thus the clamping member 55 and the body 52 are obliquely arranged.

Figure 11:
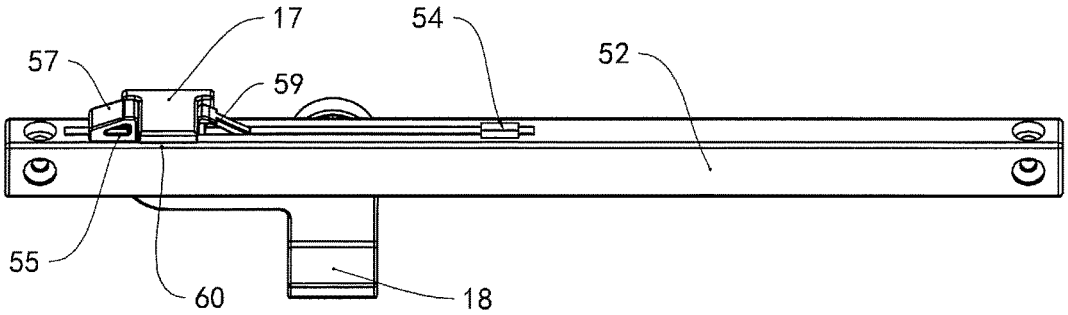
FIG. 11 illustrates a structural enlarged view of a closer and a limiting member under a second state in a shower door according to an embodiment of the present invention.

While the movable door 10 slides leftwards, the limiting member 13 moves leftwards with the movable door 10 and slides into the clamping mouth 60. Since the clamping member 55 is obliquely arranged, a limiting end of the limiting member 13 can smoothly slide into the clamping mouth 60. In addition, since the outer side surface of the clamping block 58 has an inclined surface 59, the limiting end of the limiting member 13 is more convenient to slide into the clamping mouth 60. As the movable door 10 continuous to slide leftwards, the clamping member 55 slides leftwards under the drive of the limiting end of the limiting member 13, as illustrated in FIG. 11. When the clamping member 55 slides to a leftmost side of the sliding groove 62, the clamping member 55 cannot continuously slide leftwards and the movable door 10 also slides to a limit position of the maximum travel, i.e., the movable door 10 is at a position in a closed state.

It can be seen that the limiting end of the limiting member 13 slides into the clamping mouth 60 of the clamping member 55 in a closing process of the movable door 10. After the limiting block 17 of the limiting member 13 slides into the clamping mouth 60, since the movable door 10 further needs to drive the clamping member 55 to slide, the sliding speed of the movable door 10 can be decreased, thus the impact force produced when the movable door 10 is closed is decreased, and the frame, the track and the like are prevented from being influenced.

Alternatively, a certain damping is produced when the clamping member 55 slides in the sliding groove 62. For example, a damper is arranged in the sliding groove 62, such that the sliding speed of the clamping member 55 in the sliding groove 62 is effectively reduced and the impact force produced when the movable door 10 is closed can be better decreased. Or, a cushioning member such as sponge or soft rubber is arranged on the leftmost side of the sliding groove 62 and the impact force produced when the movable door 10 slides to the limit position can also be decreased.

Preferably, the closer 51 is a flexible closer, i.e., the body 52 of the closer 51 or the clamping member 55 is made of a material such as plastic with low hardness, and thereby the impact force produced when the movable door 10 is closed can also be decreased, so as to prevent the damage of the movable door 10 due to high speed movement Since two closers 51 are provided on the track 41, when the movable door 10 slides from left to right, the limiting block 68 of the limiting member 64 can also slide into the clamping mouth 60 of the clamping member 55 of the closer 51 on the right side, so as to guarantee that the impact force is small when the movable door 10 rightwards slides to the limit position. In addition, under the joint effect of the anti-bouncing blocks 18, 69 of the two limiting members 13, 64, the movable door can be guaranteed to bounce less in the sliding process.

Of course, the above-mentioned embodiments are just preferred embodiments of the present invention. During actual application, the present invention may have more variations. For example, no fixed door is arranged for the openable and closable door of the shower room but two movable doors are arranged, the rolling wheel assemblies and the limiting member are provided on each movable door, correspondingly two different closers are provided on the track and each closer is matched with the limiting member on one movable door. Besides, the shape of the limiting block of the limiting member may also be other different shapes such as triangular shape and regularly hexagonal shape, correspondingly the shape of the clamping mouth may also be arranged to be a shape which is the same as the shape of the limiting member and such variations can also realize the purpose of the present invention.

From the sliding process of the shower door, it can be seen that the structure of the openable and closable door of the shower door is simple, the attractiveness is good, the speed can be greatly reduced when the movable door slides to the limit position, and thereby the movable door is prevented from producing great impact force which causes the movable door, the track and the like to be damaged.

INDUSTRIAL APPLICABILITY

Parts used by the shower room provided by the present invention are fewer, the assembling difficulty is smaller, the shower door can be assembled on site in the shower room, the sliding distance of the clamping member of the closer can be adjusted according to the actual sliding distance of the movable door and the use demands at different places are satisfied.

The invention claimed is:

1. A shower door, comprising:

a movable door, at least one rolling wheel being fixed on the movable door and at least one limiting member being fixed on the movable door; and a track assembly, the track assembly comprising a track, the track being arranged below the rolling wheel, a closer being fixed on the track, the closer comprising a clamping member, a middle portion of the clamping member being provided with a clamping mouth facing upwards when the closer is fixed on the track;

wherein the limiting member comprises a limiting block and an anti-bouncing block, the limiting block is located over the track, the limiting block is adapted to be releasably clamped in the clamping mouth of the clamping member and the anti-bouncing block is located underneath the track, wherein the limiting member further comprises a limiting member body, the limiting block is located at an upper end of the limiting member body and the anti-bouncing block is located at a lower end of the limiting member body, wherein the limiting block and the anti-bouncing block both extend perpendicularly from to the limiting member body;

wherein a circular groove is provided in a circumference of the rolling wheel and the rolling wheel is rollable along the track with the circular groove engaging the track, a distance between the anti-bouncing block and a lower wall of the track is smaller than a depth of the groove of the rolling wheel.

2. The shower door according to claim 1, wherein an attaching piece is attached to a surface of the track.

3. The shower door according to claim 1, wherein two threaded holes are provided in the limiting member body and screws penetrate through the threaded holes and fix the limiting member on the movable door.

4. The shower door according to claim 1, wherein the closer is provided at a first end of the track and a second closer is provided at a second end of the track.

5. The shower door according to claim 1, wherein the closer further comprises a body, a sliding groove is provided in the closer body and the clamping member is slidable back and forth in the sliding groove.

6. The shower door according to claim 5, wherein one end of the sliding groove is provided with a concave hole, the clamping member is angled relative to the closer body when the clamping member slides to the concave hole and one clamping block of the clamping member is located in the concave hole.

7. The shower door according to claim 1, wherein a mounting groove is provided in the track, the closer is mounted in the mounting groove and a clamping block of the clamping member extends over the track.

* * * * *